US009970610B1

(12) United States Patent
Sandberg

(10) Patent No.: US 9,970,610 B1
(45) Date of Patent: May 15, 2018

(54) COOLER WITH LED LIGHTING

(71) Applicant: Liddup LLC, Las Vegas, CA (US)

(72) Inventor: Jayson T. Sandberg, Las Vegas, NV (US)

(73) Assignee: Liddup, LLC, Las Vegas, NV (US)

( * ) Notice: Subject to any disclaimer, the term of this patent is extended or adjusted under 35 U.S.C. 154(b) by 0 days. days.

(21) Appl. No.: 15/456,511

(22) Filed: Mar. 11, 2017

Related U.S. Application Data

(63) Continuation of application No. 13/794,838, filed on Mar. 12, 2013, now abandoned, which is a continuation-in-part of application No. 13/539,390, filed on Jun. 30, 2012, now Pat. No. 8,511,846, which is a continuation of application No. 13/184,516, filed on Jul. 16, 2011, now Pat. No. 8,210,702, which is a continuation of application No. 13/010,078, filed on Jan. 20, 2011, now Pat. No. 7,984,997.

(60) Provisional application No. 61/424,618, filed on Dec. 17, 2010.

(51) Int. Cl.

| | |
|---|---|
| ***F21S 9/03*** | (2006.01) |
| ***F21V 23/04*** | (2006.01) |
| ***F21V 3/02*** | (2006.01) |
| ***F21V 33/00*** | (2006.01) |
| ***F21S 4/28*** | (2016.01) |
| ***B65D 81/38*** | (2006.01) |
| ***B65D 85/72*** | (2006.01) |
| ***B65D 43/16*** | (2006.01) |
| ***F25D 3/06*** | (2006.01) |
| ***F25D 23/12*** | (2006.01) |
| ***F25D 27/00*** | (2006.01) |
| ***F21Y 115/10*** | (2016.01) |
| ***F21Y 103/10*** | (2016.01) |
| ***B65D 25/28*** | (2006.01) |

(52) U.S. Cl.
CPC ..... *F21S 9/03* (2013.01); *B65D 25/28* (2013.01); *B65D 43/16* (2013.01); *B65D 81/3816* (2013.01); *B65D 85/72* (2013.01); *F21S 4/28* (2016.01); *F21V 3/02* (2013.01); *F21V 23/0442* (2013.01); *F21V 33/008* (2013.01); *F25D 3/06* (2013.01); *F25D 23/12* (2013.01); *F25D 27/005* (2013.01); *F21Y 2103/10* (2016.08); *F21Y 2115/10* (2016.08); *F25D 2700/02* (2013.01)

(58) Field of Classification Search
CPC ..... F21L 4/00; F21L 4/02; F21L 4/04; F21L 4/08; F25D 27/00; F25D 27/005; F25D 2327/001; F25D 3/02; F25D 3/00; F25D 3/08; F25D 3/06; F25D 23/066
USPC ..... 362/92, 94; 62/457.1
See application file for complete search history.

(56) References Cited

U.S. PATENT DOCUMENTS 4,240,272 A * 12/1980 Tiede ..... A45C 11/20 215/12.1
5,980,058 A * 11/1999 Guess ..... F25D 27/00 362/155

(Continued)

*Primary Examiner* — William N Harris
(74) *Attorney, Agent, or Firm* — Clause Eight IPS; Michael Catania

(57) ABSTRACT

A cooler that utilizes multiple LEDs to illuminate an entire interior is disclosed herein. The LEDs are automatically activated by a switch positioned in the cooler. When the lid is in an open state, the switch completes a circuit from a battery to the LEDs thereby allowing the LEDs to illuminate the entire interior chamber of the cooler. The LEDs are preferably covered by a lens.

5 Claims, 15 Drawing Sheets

(56) References Cited

U.S. PATENT DOCUMENTS

| | | | | |
|---|---|---|---|---|
| 2003/0046947 | A1* | 3/2003 | Ohya | A61L 9/16 62/264 |
| 2004/0264168 | A1* | 12/2004 | Gotz | F24C 15/008 362/92 |
| 2006/0193126 | A1* | 8/2006 | Kuelbs | B25H 3/02 362/155 |
| 2009/0190369 | A1* | 7/2009 | Elwell | B60Q 1/2607 362/541 |
| 2009/0244884 | A1* | 10/2009 | Trulaske, Sr. | A47F 3/001 362/94 |
| 2010/0212344 | A1* | 8/2010 | Mattucci | F25D 27/00 62/264 |
| 2010/0242520 | A1* | 9/2010 | Weir | F25D 27/00 62/264 |
| 2010/0320890 | A1* | 12/2010 | Jung | F25D 27/00 312/402 |
| 2011/0216529 | A1* | 9/2011 | Weng | F21L 4/00 362/183 |

* cited by examiner

COOLER WITH LED LIGHTING

CROSS REFERENCES TO RELATED APPLICATIONS

The Present Application is a continuation application of U.S. patent application Ser. No. 13/794,838, filed on Mar. 12, 2013, which is a continuation-in-part application of U.S. patent application Ser. No. 13/539,390, filed on Jun. 30, 2012, now U.S. Pat. No. 8,511,846, issued on Aug. 20, 2013, which is a continuation application of U.S. patent application Ser. No. 13/184,516, filed on Jul. 16, 2011, now U.S. Pat. No. 8,210,702, issued on Jul. 3, 2012, which claims priority to U.S. Provisional Patent Application No. 61/424,618, filed on Dec. 17, 2010, and which is a continuation application of U.S. patent application Ser. No. 13/010,078, filed Jan. 20, 2011, now U.S. Pat. No. 7,984,997, issued on Jul. 26, 2011, all of which are hereby incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present invention generally relates to portable beverage coolers.

Description of the Related Art

The prior art discusses various coolers, including coolers with lighting.

Winslow, U.S. Pat. No. 4,754,376 for an Automatic Ice Chest Light discloses a lighting device (light bulb) attached to n interior surface of a lid of an ice chest that is automatically activated when the lid is raised and deactivates when the lid is closed by way of a mercury switch.

Bania, U.S. Pat. No. 6,182,462 for an Internally Illuminated Cooler Box, discloses an incandescent light bulb built into an internal wall of a lid of a cooler box and which is activated by an automatic spring loaded switching mechanism.

Pashley et al., U.S. Pat. No. 6,726,341 for a LED Illumination For Cold Storage Compartments discloses the use of LED lighting for a cold storage compartment.

Blanchard et al., U.S. Pat. No. 6,519,965 for an Externally Illuminated Cooler Box, discloses an incandescent light bulb built into an external side wall of a cooler box and which is activated by a switching mechanism.

Wyatt, U.S. Pat. No. 6,997,007 for a Light Assembly And Cooler System discloses a light assembly positioned on a front wall of a cooler and having an interior illumination panel and an exterior illumination panel which is controlled by a switch that deactivates the lighting when the lid is closed.

Incandescent lights have heat-driven emissions which use an electric current through a filament and produce light along with heat. This light source is completely useless for application to a cooler since it directly takes away from the basic functionality of a cooler. Fluorescent lights use a gas-discharge lamp and electricity to excite mercury vapor, producing a short-wave ultraviolet light that causes a phosphor to fluoresce, in turn producing actual, visible light. This type of light source is cost efficient however requires a ballast to regulate current through a bulb or lamp. Ballasts take up volume and generate heat. Since volume maximization is a primary attribute to be contained, a fluorescent light with a ballast is an improbable solution. Also, fluorescent bulbs are extremely fragile, with the possibility of breakage upon closing of the lid which would expose the hazardous gas and mercury within the cooler.

The prior art, although providing various means for illuminating a cooler, has still not addressed all of the problems with illuminating a portable cooler. The entire interior of the cooler should be illuminated and should be illuminated for an extensive period without an external power source. Also, the illumination should only create a minimal amount of heat in order for the cooler to serve its primary function of cooling the contents of the cooler. The cooler should also have an "automatic" switch to activate the illumination, and the switch should be durable.

BRIEF SUMMARY OF THE INVENTION

The cooler of the present invention resolves the problems associated with prior art coolers by providing a cooler that utilizes multiple light emitting diodes ("LED") to illuminate the entire interior of the cooler by unique placement of the LEDs which allows for a minimal number of LEDs to minimize power consumption. The LEDs are preferably covered by a lens. The LEDs are activated by a switch positioned in the cooler. The switch completes a circuit from a battery to the LEDs thereby allowing the LEDs to illuminate the entire interior of the chamber of the cooler. Each of the LEDs is preferably positioned along an upper region of the main body in which the upper region extends from an upper edge of the main body to 2 inches below the upper edge. The interior chamber preferably has a volume ranging from 40 quarts to 50 quarts. The LEDs can preferably illuminate the interior chamber of the cooler for at least four hours of continuous use.

The present invention is generally directed to a portable cooler with LED lighting. An illustrative embodiment of the cooler includes a lid and an interior chamber. The cooler has a main body having a plurality of insulated walls that define an interior chamber and a lid attached to the main body wherein the lid is moveable from a closed state to an open state. A plurality of LEDs are positioned along an upper region of the main body and each of the plurality of LEDs has a millicandela ranging from 4000 to 20000. Further included is a nine volt battery for providing power to each of the plurality of LEDs. There is at least one 1.5 watt 5% tolerance 220 ohm resistor positioned between the nine volt battery and the plurality of LEDs. The present invention is further directed to a circuit for a lighting system for the cooler having a lid and interior chamber.

The present invention further comprises a circuit for a lighting system for a cooler having a lid and an interior chamber. The circuit comprises a plurality of LEDs, each of the LEDs having a millicandela ranging from 4000 to 20000, a nine volt battery, at least one 1.5 watt 5% tolerance 220 ohm resistor positioned between the nine volt battery and the plurality of LEDs and a switch positioned between the nine volt battery and the plurality of LEDs. The switch is in a closed state when the lid of the cooler is open, allowing power to flow to each of the plurality of LEDs for illuminating the interior chamber of the cooler.

In another embodiment of the present invention, the cooler capable of illuminating an exterior are comprises a main body having a plurality insulated walls that define an interior chamber, each of the insulated walls having an interior surface and an exterior surface. A lid is attached to the main body, the lid moveable from a closed state to an open state. The cooler further comprises a plurality of LEDs positioned along the outer surface of an insulated wall of the plurality of insulated walls of the main body. Each of the LEDs has a millicandela of at least 20000. The cooler comprises a nine volt battery for providing power to each of the plurality of LEDs and at least one 1.5 watt 5% tolerance 220 ohm resistor positioned between the nine volt battery and the plurality of LEDs. Further included is an on/off rocker switch positioned on the main body, the on/off rocker switch completing a circuit from the battery to the plurality of LEDs allowing the plurality of LEDs to an exterior area to the cooler.

In yet another embodiment, the cooler has solar panels.

In yet another embodiment, the liner of the cooler is composed of a FDA grade polypropylene material infused with colloidal silver to kill bacteria. Alternatively, the liner is infused with TEFLON® material to prevent staining.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
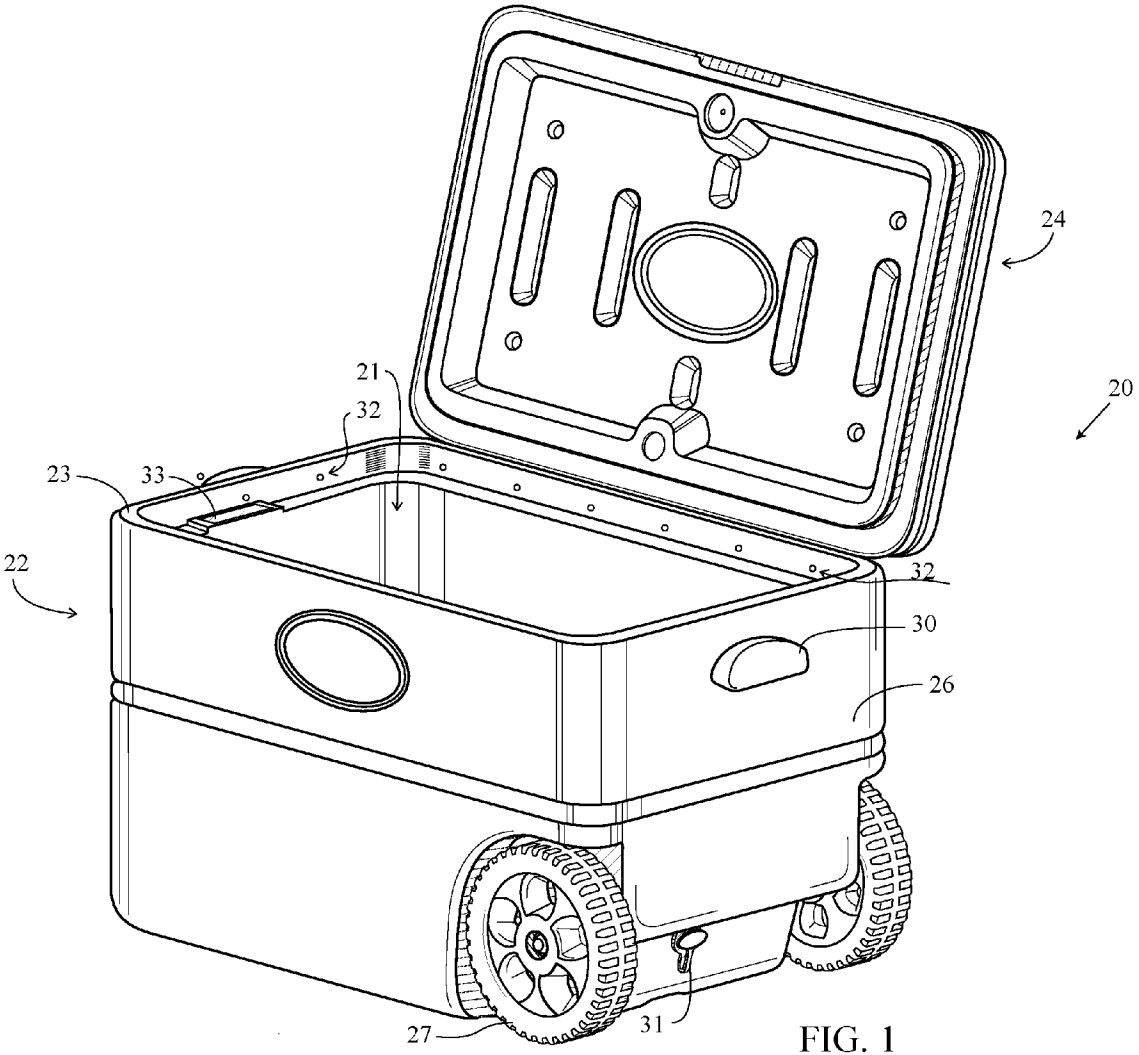
FIG. 1 is a top perspective view of a preferred embodiment of a cooler.
Figure 1A:
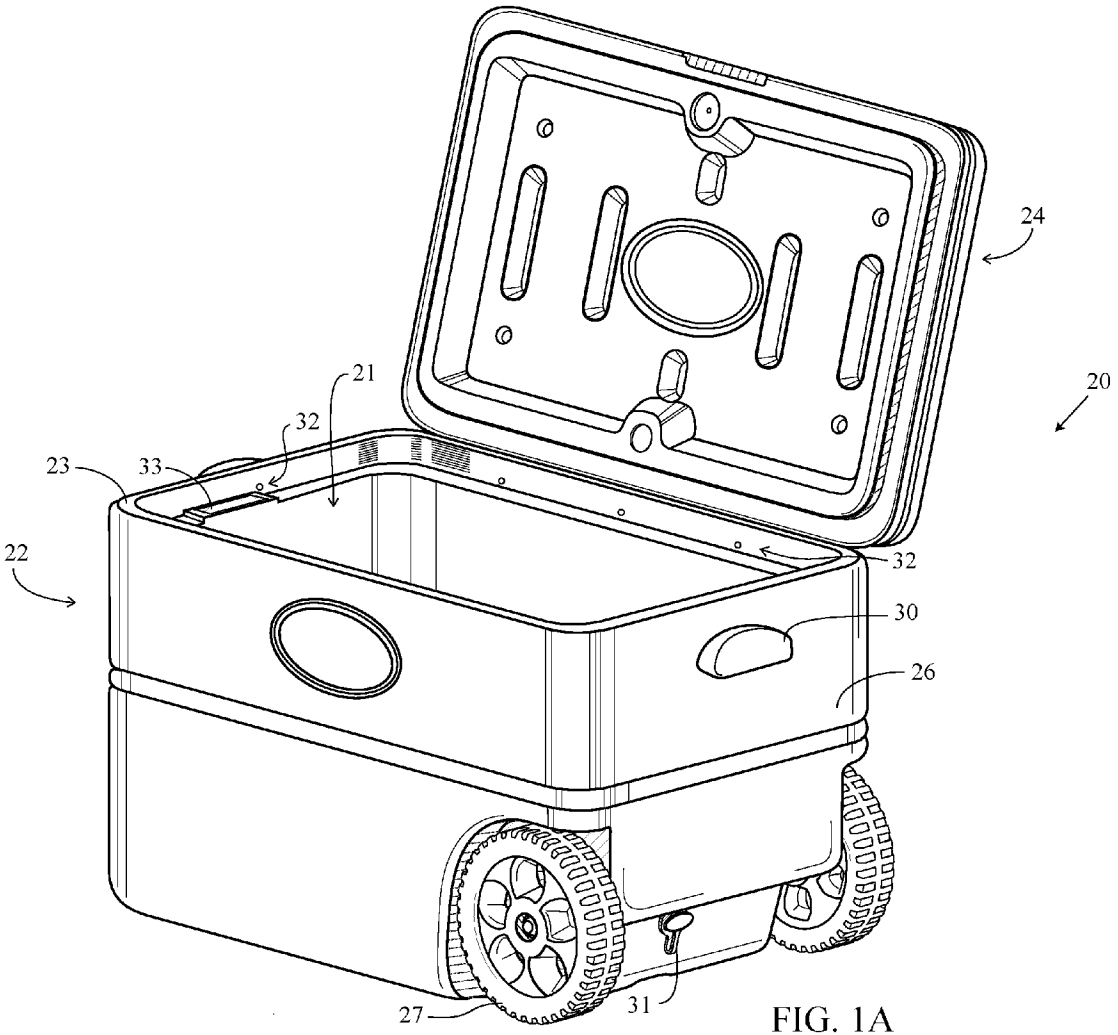
FIG. 1A is a top perspective view of an alternative embodiment of a cooler.
Figure 2:
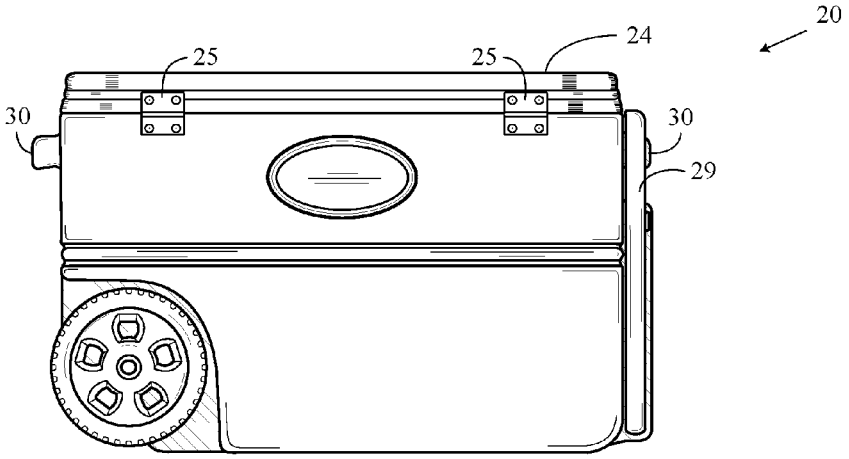
FIG. 2 is a hinged side elevational view of a preferred embodiment of a cooler.
Figure 3:
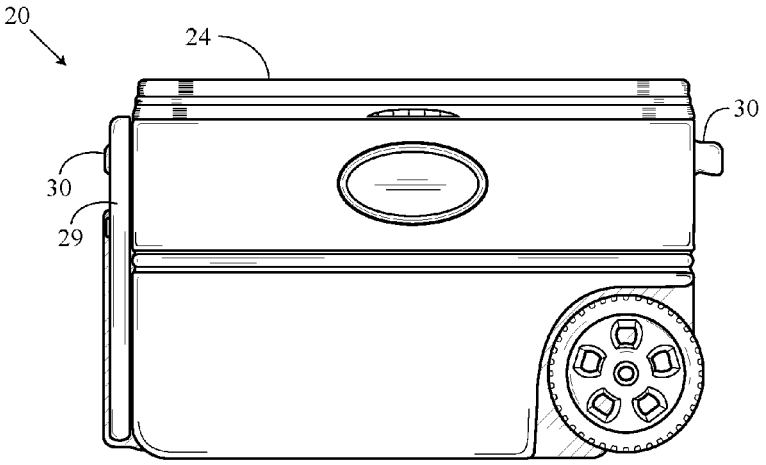
FIG. 3 is a side elevational view of a preferred embodiment of a cooler.

As shown in FIGS. 1 and 1A, a portable cooler 20 has a lid 24 and a main body 22 having an interior chamber 21. The lid 24 is preferably made of high density polyethylene (HDPE). The main body 22 comprises an outer liner 26 and an inner liner 34 that defines an interior chamber 21. The lid 24 is attached to the main body 22, and the lid 24 movable from a closed state to an open state. Multiple LEDs 32 are positioned along an upper region of the main body 22. Each of the plurality of LEDs 32 preferably has a millicandela ranging from 4000 to 20000. The cooler 20 also preferably has a pair of wheels 27 and a drain plug 31.

The cooler 20 further preferably comprises at least one battery 41, positioned within a battery compartment, for providing power to each of the plurality of LEDs 32. The battery 41, not shown, preferably has a battery cover with backing made of polypropylene (PP). The preferred thickness of the wall of the backing is approximately 0.100 inch and the preferred weight is approximately 0.010 pounds. Additionally, the battery 41, not shown, preferably has at least a 0.025 inch thick adhesive backed foam on the bottom of the battery 41. The battery 41 is preferably placed in the battery compartment, which is in the upper region of the main body 22 to allow for maximum cooler space. Further, the battery is in close proximity to plurality of LEDs 32 in order to reduce power loss through resistance of the wires and to prevent unnecessary heating of the cooler by having electrical wires conducting electricity positioned throughout the cooler 20.

At least one 1.5 watt 5% tolerance 220 ohm resistor 40 is preferably positioned between a nine volt battery 41 and the plurality of LEDs 32.

The foam of the main body 22 of the cooler 20 preferably weighs approximately 2.6 to 3.0 pounds. The foam of the lid 24 of the cooler roughly weighs between 0.2 to 0.8 pounds. The interior capacity of the cooler 20 is preferably approximately 48 quarts to 50 quarts.

As shown in FIGS. 9-11 and 15-17, the cooler 20 is further defined by an inner liner 34 and an outer liner 26 of the main body 22. A switch 42 is positioned between the inner liner 34 and outer liner 26 of the main body 22 in a compartment 33.

Figure 11:
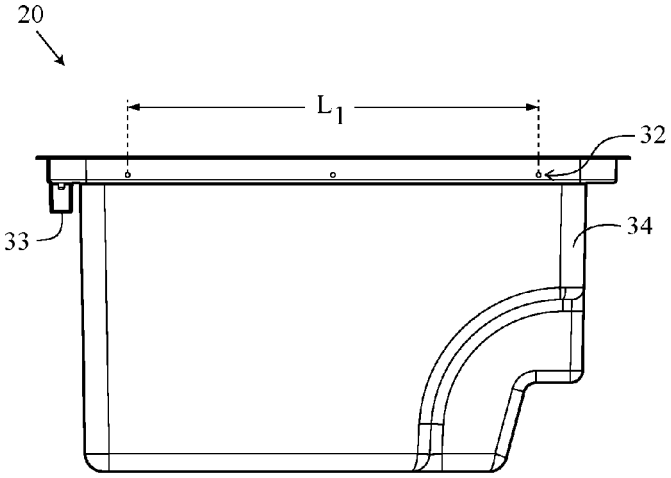
FIG. 11 is a side elevational view of an inner liner of a main body of a preferred embodiment of a cooler.

In this embodiment, the switch is a magnet reed switch 42. The liner is preferably made of high density polyethylene (HDPE). Further, a magnet 45 is positioned in the lid 24, wherein a magnetic field 46 of the magnet 45 is in an activating location when the lid 24 is in an open state, wherein the magnetic reed switch 42 completes a circuit 40 from the battery 41 to the plurality of LEDs 32 thereby allowing the plurality of LEDs 32 to illuminate the interior of the chamber 21 of the cooler 20. As shown in FIG. 11, a distance L1 is preferably approximately 16 inches.

Figure 12:
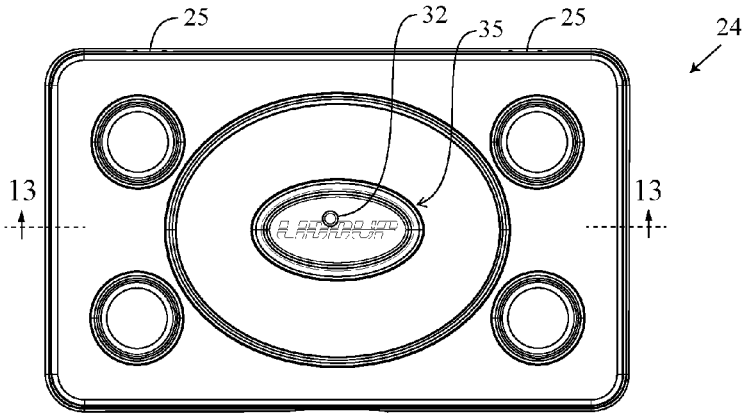
FIG. 12 is a top plan view of a lid of an alternative embodiment of a cooler.
Figure 13:
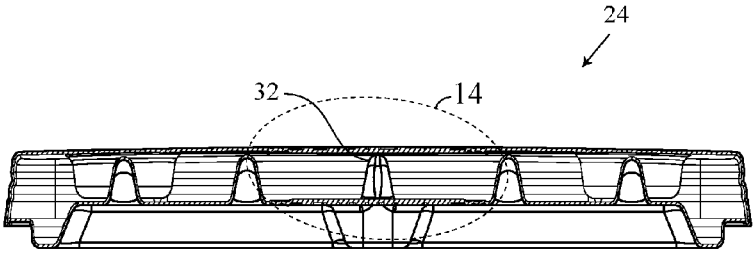
FIG. 13 is a cross-sectional view of the lid of FIG. 12 along line 13-13.
Figure 14:
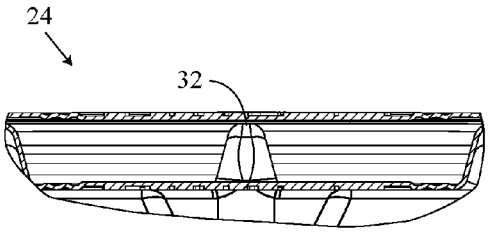
FIG. 14 is an isolated view of portion 14 of FIG. 13.
Figure 15:
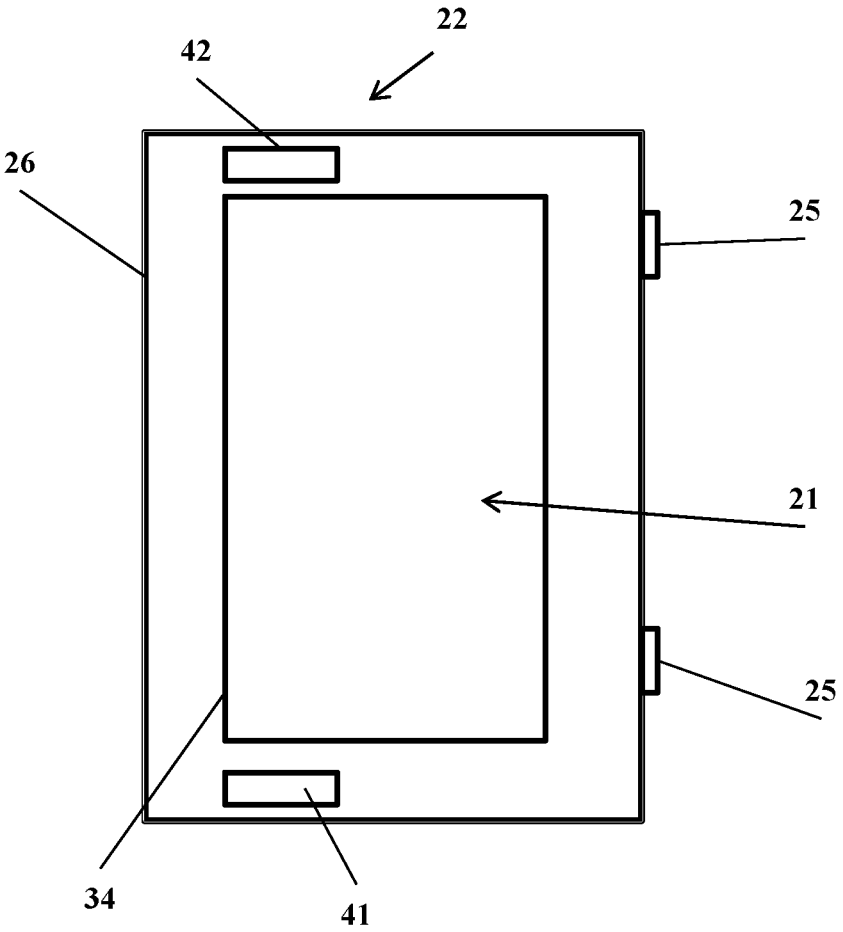
FIG. 15 is a plan view of a main body of a cooler illustrating a magnetic reed switch positioned within an outer liner and inner liner of the main body.
Figure 16:
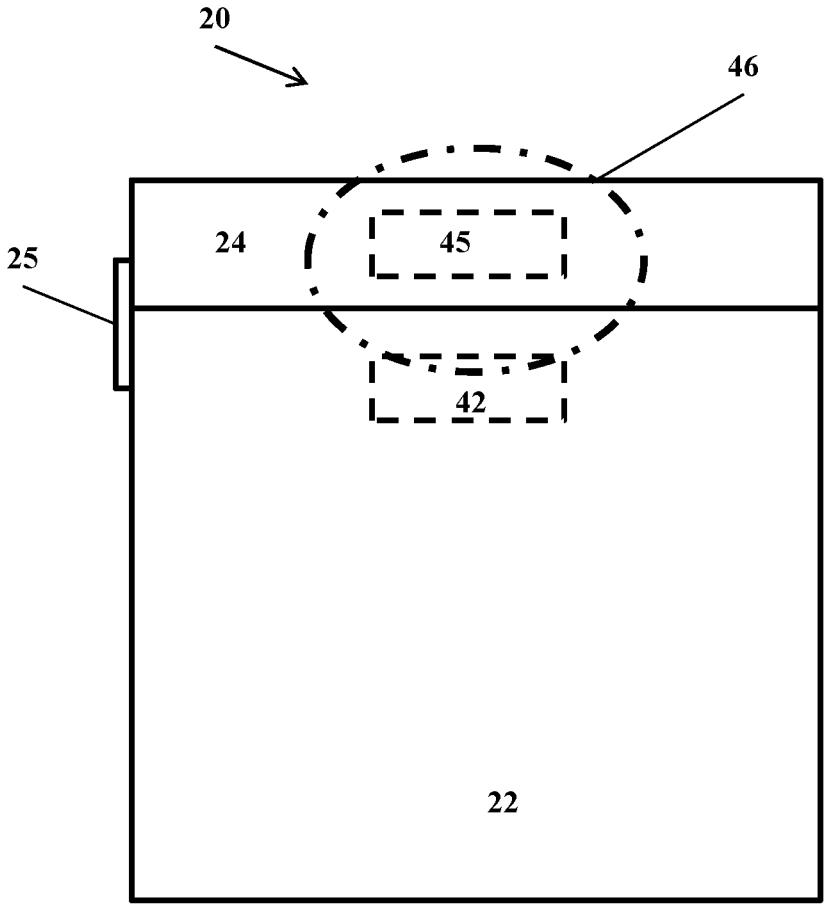
FIG. 16 is a side view of a cooler in a closed lid state with a magnetic reed switch in dashed lines in a main body of the cooler and a magnet in dashed lines in a lid of the cooler with a magnetic field in dashed lines.

In an alternative embodiment of the present invention illustrated in FIGS. 12-14, the cooler 20 is capable of illuminating an exterior area of the cooler 20 through an LED 32 in a lid illuminating area 35 of the lid 24. The material of the lid illuminating area 35 is preferably transparent allowing for the LED 32 to illuminate an exterior area of the cooler 20.

The cooler 20 comprises a main body 22 having a plurality of insulated walls that define an interior chamber 21. Each of the plurality of insulated walls has an interior surface that is preferably white in color, which is standard in the cooler industry. The white interior surface serves multiple purposes for the cooler 20, in addition to providing a reflecting amplifier for the LEDs 32, allowing for fewer and lower power LEDs 32 to be used while still illuminating the entire interior chamber 21 of the cooler 20.

Figure 4:
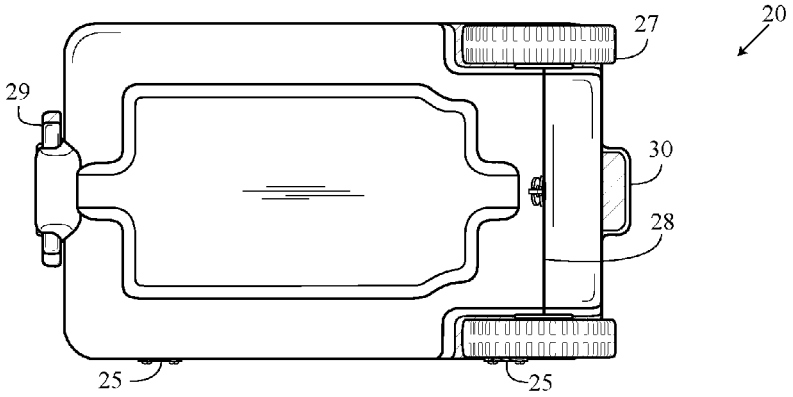
FIG. 4 is a bottom plan view of a preferred embodiment of a cooler.
Figure 5:
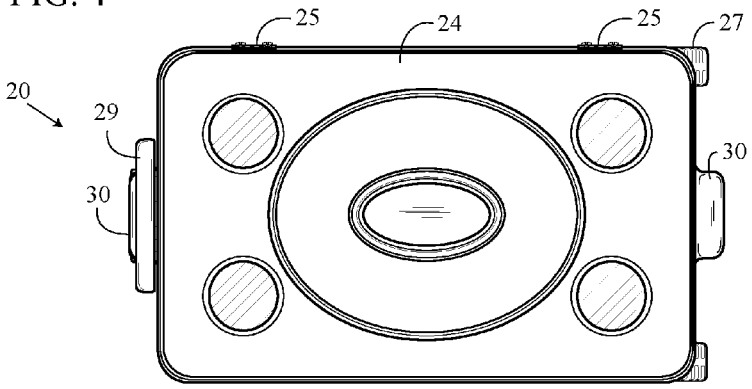
FIG. 5 is a top plan view of a preferred embodiment of a cooler.
Figure 6:
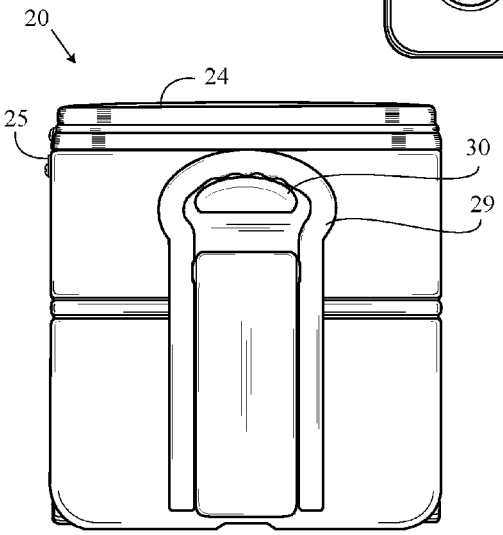
FIG. 6 is a front elevational view of a preferred embodiment of a cooler.
Figure 7:
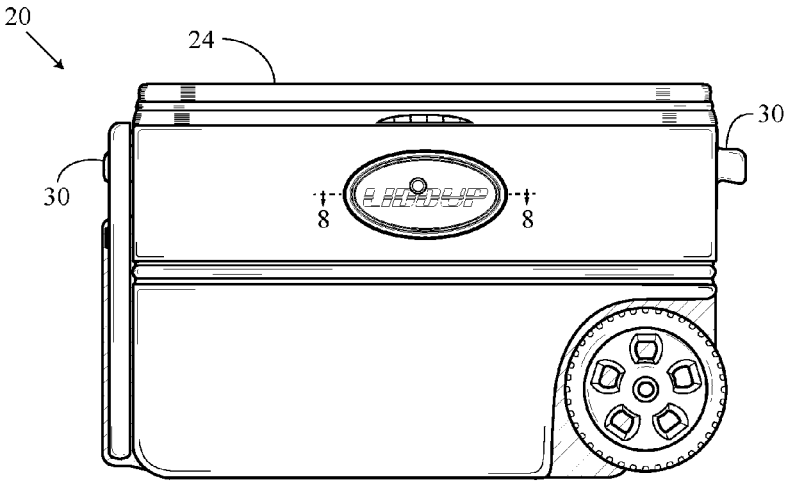
FIG. 7 is a side elevational view of an alternative embodiment of a cooler.
Figure 8:
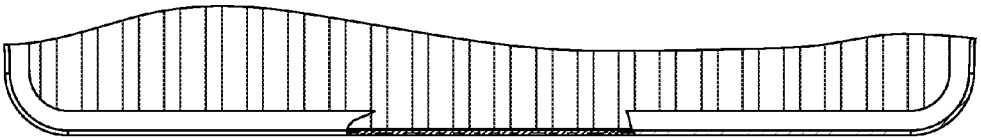
FIG. 8 is a cross-sectional view along line 8-8 of FIG. 7 illustrating a transparent portion of an outer liner of a main body of a cooler.
Figure 9:
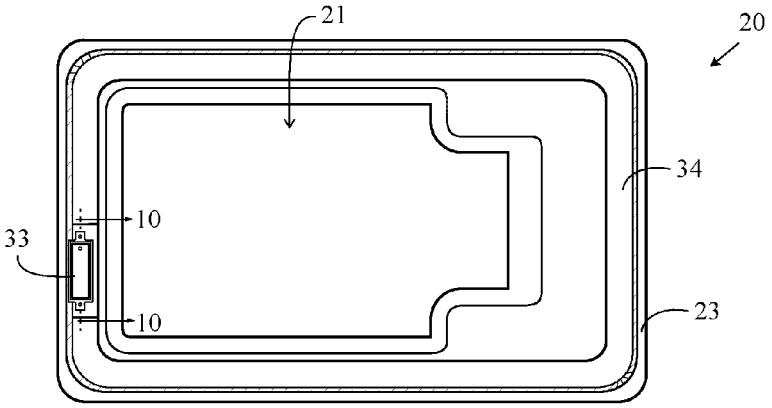
FIG. 9 is a top plan view of a main body of a preferred embodiment of a cooler illustrating an open interior of the main body of the cooler.
Figure 10:
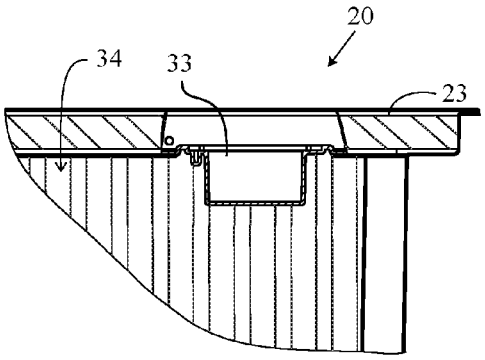
FIG. 10 is an isolated cross-sectional view of a portion of the cooler along lines 10-10 of FIG. 9.

As shown in FIGS. 2-8, the lid 24 of the cooler 20 is attached to the main body 22 by a plurality of hinges 25, wherein the lid 24 is movable from a closed state to an open state. The hinges 25 are placed on a hinge side of the cooler 20 while the magnetic reed switch 42, not shown, is preferably positioned on an opposite of the hinge side as disclosed below. The cooler 20 preferably has a pair of gripping handles 30 and a pulley handle 29 opposite of the wheels 27. As shown in FIG. 4, the wheels 27 are preferably attached to each other by a rotating shaft 28. As shown in FIGS. 7 and 8, an alternative embodiment has a transparent signage portion that may be illuminated by an LED.

Figure 18:
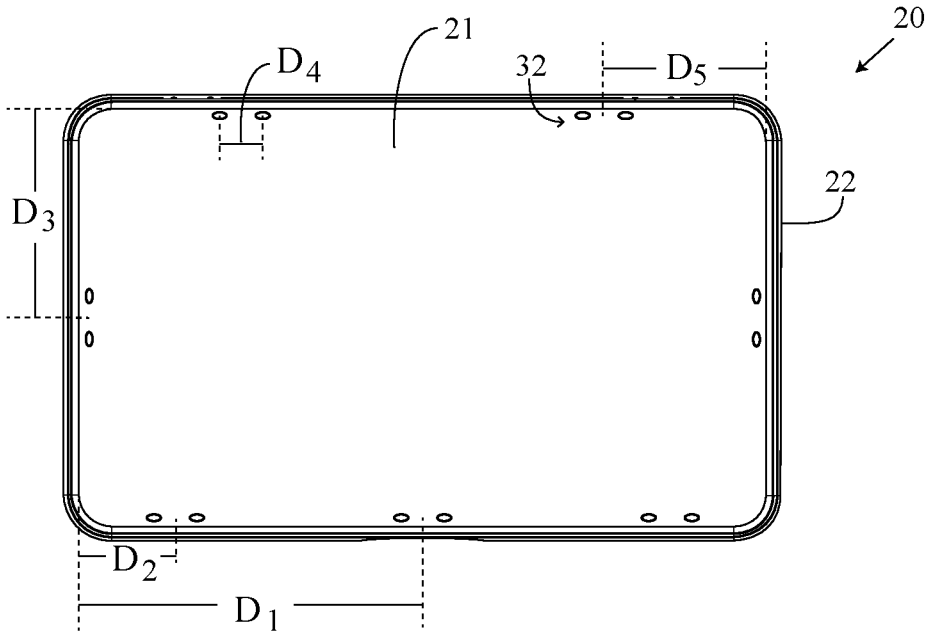
FIG. 18 is a top view of an isolated view of the interior of the cooler.

As shown in FIGS. 1, 1A and 18, a plurality of LEDs 32 are positioned along the interior surface of the main body 22 of the cooler, below a rim 23 of the main body 22. The LEDs 32 are the preferred light source for application in the cooler 20 since LEDs are more energy-efficient than traditional light sources, emit low-intensity light, generate the absolute minimum amount of heat and do not take up any volume in the cooler 20. Placement of the LEDs 32 is designed for maximum illumination from the minimal number of LEDS 32, as well as utilizing reflection of the white interior liner. The placement of the LEDs 32 is preferably in the upper region of the cooler 20 where the lid 24 rests when in a closed position. The placement of the LEDs 32 in the upper lip of the cooler 20 allows for physical protection of the LEDs 32 when the lid 24 is in the closed position. Further, by placing the LEDs 32 as close as possible to the rim 23 of the cooler 20, optimal cooler 20 space is maximized. Also, placement of the LEDs 32 in this location allows for the maximum reflection amplification from the interior liner, regardless of the contents inside the cooler 20.

Each of the plurality of LEDs 32 has a millicandela ranging from about 4,000 to roughly 20,000. The LEDs 32 are preferably 5 mm flat top 120 degree LEDs. The 5 mm flat top 120 degree LEDs do not have a focused beam and do not have a domed surface which reduces illumination of the chamber. The invention further comprises a nine-volt battery 41 for providing power to each of the plurality of LEDs 32. To prevent power from the battery being drained quickly, at least one 1.5 watt 5% tolerance 220 ohm resistor 40 is positioned between the nine volt battery 36 and the plurality of LEDs 32.

Figure 19:
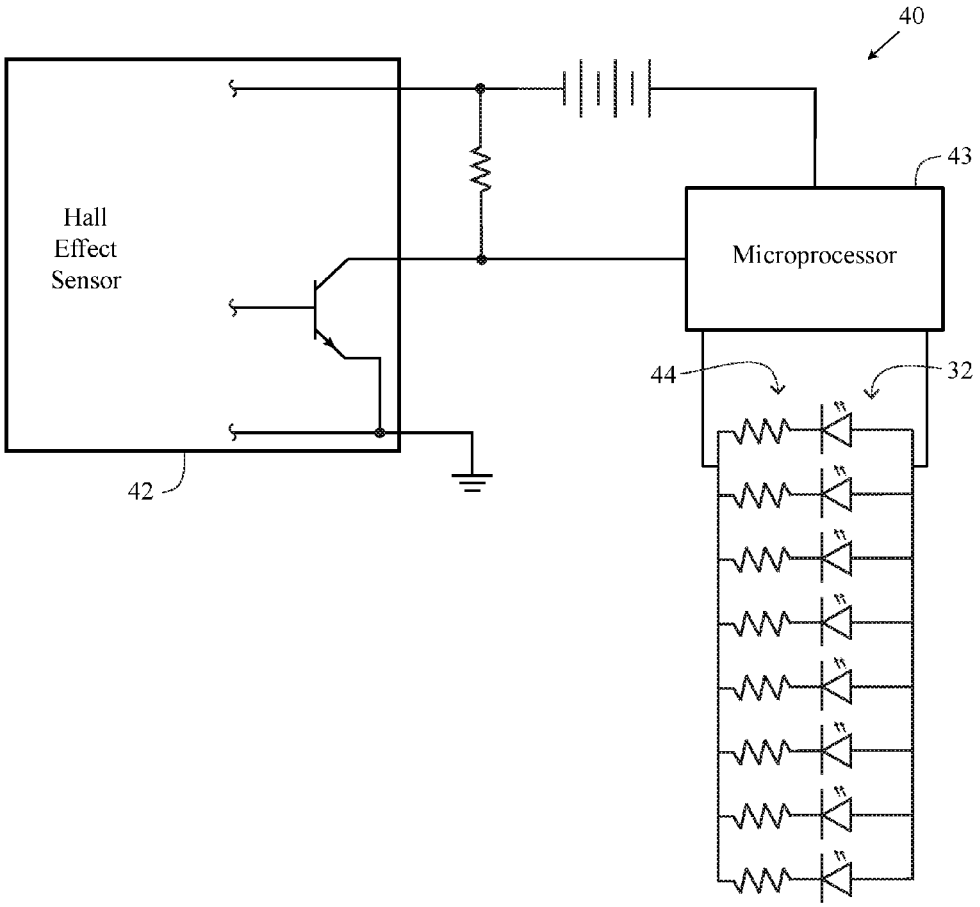
FIG. 19 is a block diagram of a circuit for a cooler with LED lighting.
Figure 19A:
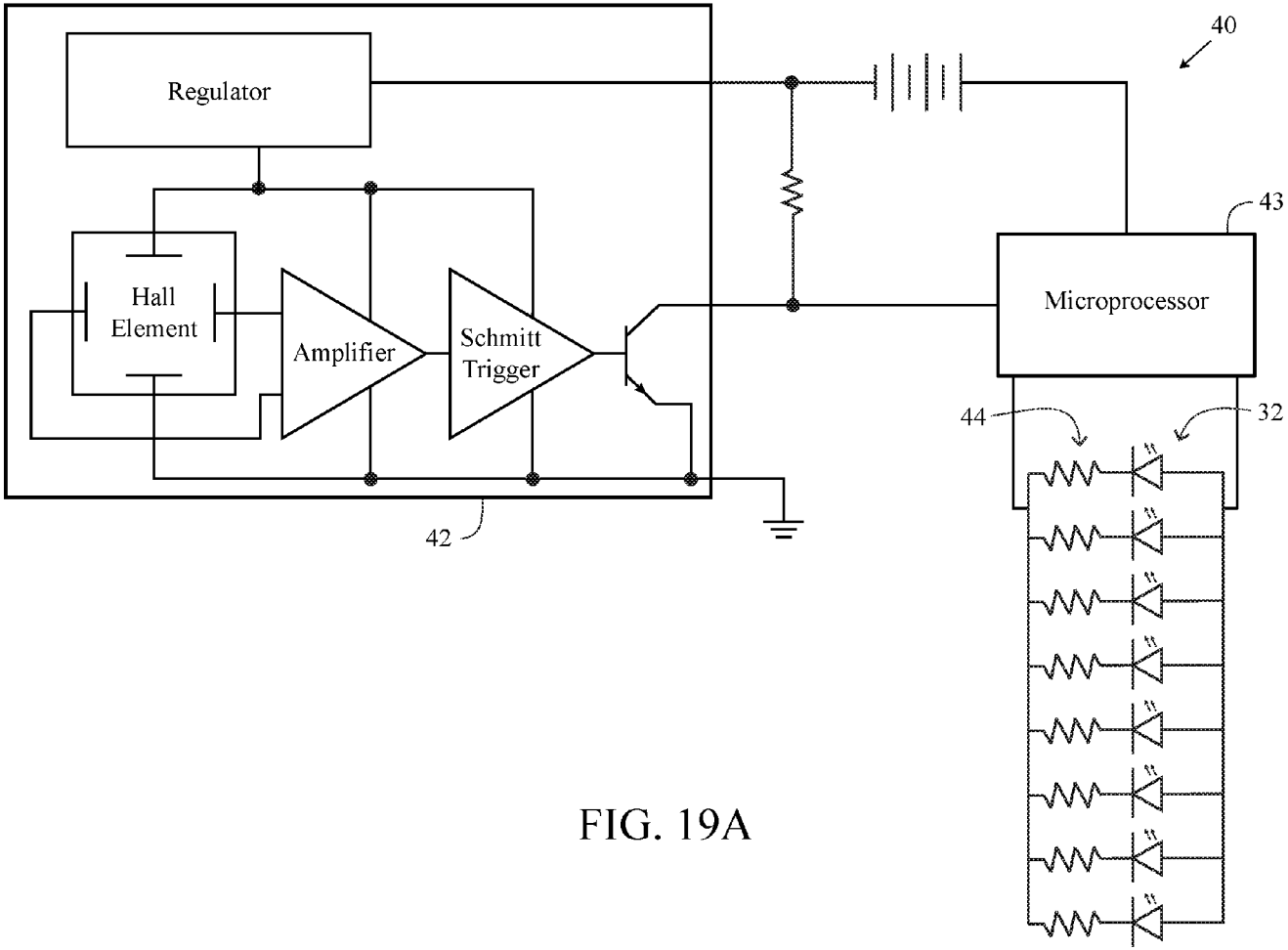
FIG. 19A is a block diagram of a circuit for a cooler with LED lighting with a Hall Effect Sensor.

As shown in FIGS. 19 and 19A, the circuit 40 for a lighting system for a cooler 20 comprises a plurality of LEDs 32, each of the plurality of LEDs 32 preferably has a millicandela ranging from 4000 to 20000. The circuit 40 further comprises a nine volt battery, a switch 42, and at least one 1.5 watt 5% tolerance 220 ohm resistor 40 positioned between the switch 42 and the plurality of LEDs 32. A microprocessor or circuit board 43 is also preferably utilized in the circuit 40.

In this embodiment, the switch is a Hall Effect sensor 42 which is positioned between the nine volt battery 41 and the plurality of LEDs 32. The Hall Effect sensor 42 includes a regulator, a Hall element, an amplifier and a Schmitt trigger. A Hall Effect sensor 42 is a transducer that varies its output voltage in response to changes in a magnetic field. The Hall effect sensor is similar to the magnetic reed switch disclosed above, albeit with no moving components. In response to the lack of a magnetic field, the Hall Effect sensor closes a circuit and activates the LEDs 32 of the cooler 20 thereby allowing power to flow from the battery 41 to each of the plurality of LEDs 32 for automatically illuminating the interior of the chamber 21 of the cooler 20 when the lid is open and the magnetic field is removed.

Figure 17:
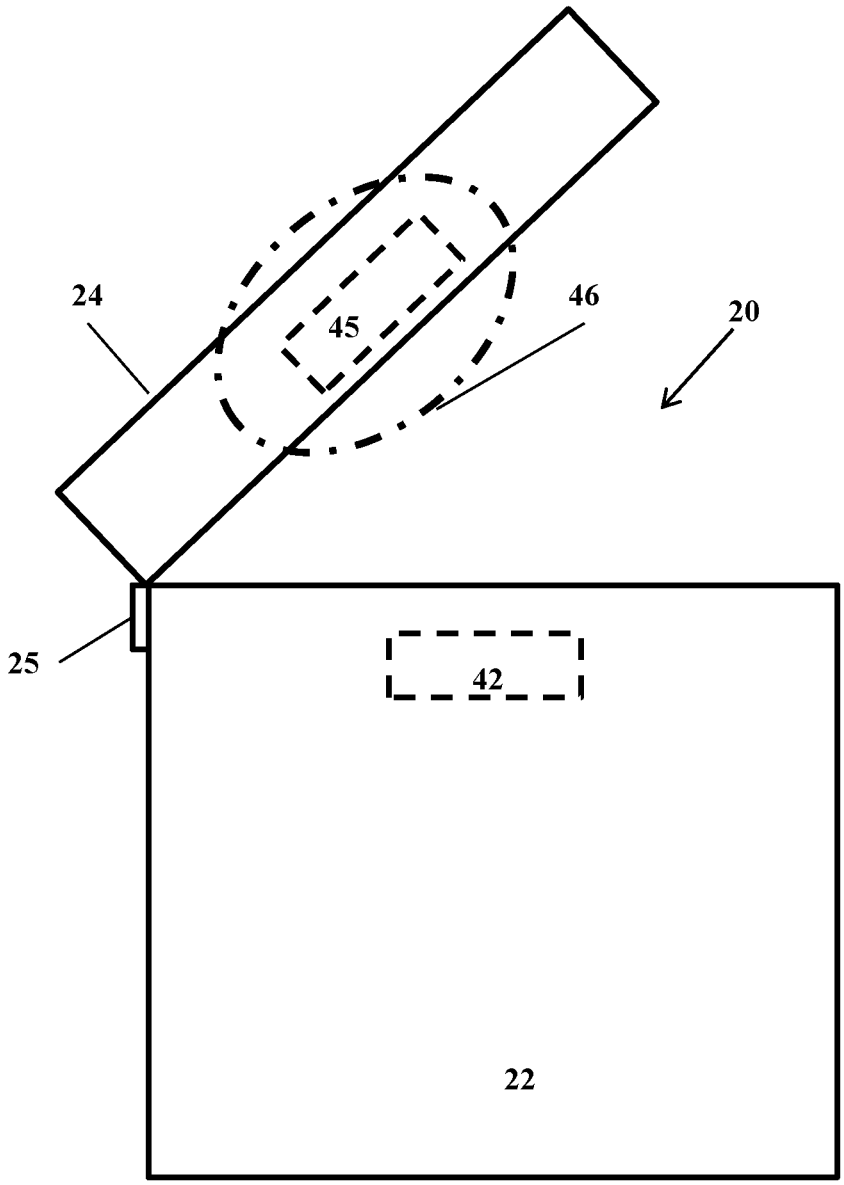
FIG. 17 is a side view of a cooler in an open lid state with a magnetic reed switch in dashed lines in a main body of the cooler and a magnet in dashed lines in a lid of the cooler with a magnetic field in dashed lines.

The switch 42 is preferably installed between the inside liner 34 and the outside liner 26 of the main body 22 of the cooler 20. Also, the activation by the removal of the magnetic field 46 (as shown in FIG. 17) generated by the magnet 45 in the lid 24 eliminates breakage from wires that must be placed in a lid of a cooler since the magnet 45 is positioned within the lid 24 without the need for wires or other connections.

A plunger switch 50 utilized with a cooler with LED lighting is disclosed in Sandberg, U.S. patent application Ser. No. 13/794,830, for a Cooler With LED Lighting, filed on Mar. 12, 2013, which is hereby incorporated by reference in its entirety. The plunger switch 50 breaks (off) or completes (on) a circuit on the common side of the circuit. When the lid 24 of the cooler 20 is in the closed position the plunger is pressed, breaking the circuit on the common side of the circuit, turning the LEDS 32 off (open circuit). When the lid 24 of the cooler 20 is open the plunger is released, completing the circuit on the common side turning the LEDS 32 on (closed circuit).

A rocker switch 51 utilized with a cooler with LED lighting is disclosed in the aforementioned Sandberg, U.S. patent application Ser. No. 13/794,830, for a Cooler With LED Lighting. An on/off rocker switch 51 is positioned on the main body 22 and the on/off rocker switch completes a circuit 40 from the battery 41 to the plurality of LEDs 32 thereby allowing the plurality of LEDs 32 to illuminate an exterior area to the cooler 20. The rocker switch 51 breaks (off) or completes (on) a circuit on the common side of the circuit. Activation of the rocker switch 51 requires the switch be manually or physically rocked into the on or off position. When the lid 24 of the cooler 20 is open the switch would be switched to the on position, completing the circuit and activating the LEDS 32 (closed circuit). When the cooler lid 24 is shut the switch would then need to be turned into the off position, breaking the circuit and deactivating the LEDS 32 (open circuit).

A lever switch 52 utilized with a cooler with LED lighting is disclosed in the aforementioned Sandberg, U.S. patent application Ser. No. 13/794,830, for a Cooler With LED Lighting. The lever switch 52 breaks (off) or completes (on) a circuit on the common side of the circuit. When the lid 24 of the cooler 20 is in the closed position the lever is pressed, breaking the circuit on the common side of the circuit, turning the LEDS 32 off (open circuit). When the lid 24 of the cooler 20 is open the lever is released, completing the circuit on the common side turning the LEDS 32 on (closed circuit).

A ball switch 53 utilized with a cooler with LED lighting is disclosed in the aforementioned Sandberg, U.S. patent application Ser. No. 13/794,830, for a Cooler With LED Lighting. The ball switch 53 breaks (off) or completes (on) a circuit on the common side of the circuit. When the lid 24 of the cooler 20 is in the closed position the ball rolls away from the common leads inside of the switch breaking the circuit, turning the LEDS 32 off (open circuit). When the lid 24 of the cooler 20 is open, the ball rolls towards the common leads completing the circuit or turning the LEDS 32 on (closed circuit).

A mercury switch 54 utilized with a cooler with LED lighting is disclosed in the aforementioned Sandberg, U.S. patent application Ser. No. 13/794,830, for a Cooler With LED Lighting. The mercury switch 54 breaks (off) or completes (on) a circuit on the common side of the circuit. When the lid 24 of the cooler 20 is in the closed position the mercury rolls away from the common leads inside of the switch breaking the circuit turning the LEDS 32 off (open circuit). When the lid 24 of the cooler 20 is open the mercury rolls into the common leads, completing the circuit on the common side turning the LEDS on (closed circuit).

A light dependent resistor switch 55 utilized with a cooler with LED lighting is disclosed in the aforementioned Sandberg, U.S. patent application Ser. No. 13/794,830, for a Cooler With LED Lighting. The light dependent resistor switch 55 is a small semiconductor. Similar to the photo diode switch discussed below, in low to no ambient light situations, the light dependent resistor switch 55 can complete the circuit so the LEDS 32 will illuminate.

A proximity switch 56 utilized with a cooler with LED lighting is disclosed in the aforementioned Sandberg, U.S. patent application Ser. No. 13/794,830, for a Cooler With LED Lighting. A proximity switch 56 is a switch that is activated by either an infrared beam or magnetic field, to power the LEDs on or off.

A photo diode switch 57 utilized with a cooler with LED lighting is disclosed in the aforementioned Sandberg, U.S. patent application Ser. No. 13/794,830, for a Cooler With LED Lighting. The photo diode switch 56 acts as a switch to break (off) or complete (on) a circuit depending on the amount of ambient light present. When the cooler 20 is being used in the day time the need for the interior of the cooler 20 to be illuminated is negated because of ambient light. The photo diode will have a high resistance in the presence of ambient light and break (off) the circuit. When the ambient light is low to none (adjusted with potentiometer) the resistance value drops through the photo diode, completing the circuit (on).

The LEDs 32 operate at very low temperatures preventing the plastic material of the cooler 20 from melting. Further, the use of LEDs 32 does not affect the inside temperature of the cooler 20. Retaining the inside temperature of the cooler 20 is one of the main priorities of the cooler 20 of the present invention. In turn, this design characteristic does not take away the basic functionality of the cooler.

The use of LEDs 32 to illuminate the inside contents of the cooler 20 in low light situations provides the consumer with the capability to visually see inside the cooler 20 when other light sources are inconvenient or unavailable.

Preferably for an eight LED 32 configuration, only one battery 41 and magnetic reed switch 42 are necessary for the cooler 20. For a sixteen LED 32 configuration, two batteries 41 and two magnetic reed switches 42 are necessary for the cooler 20. Twenty-six gauge stranded wire is also preferably utilized for the electronics of the cooler 20. Two to sixteen resistors 44 are preferably utilized for the cooler 20.

A preferred embodiment of placement of the LEDs 32 in the cooler 20 are illustrated in FIG. 18. In this preferred embodiment, each LED 32 of the pairs of LEDs 32 is positioned 1.25 inches from its pair LED 32. A distance D1 is preferably 11.5 inches. A distance D2 is preferably 4.125 inches. A distance D3 is preferably 6.25 inches. A distance D4 is preferably 1.25 inches. A distance D5 is preferably 7.75 inches. Those skilled in the pertinent art will recognize that other coolers having different dimensions can have different dimensions for the above-mentioned distances without departing from the scope and spirit of the present invention.

Figure 20:
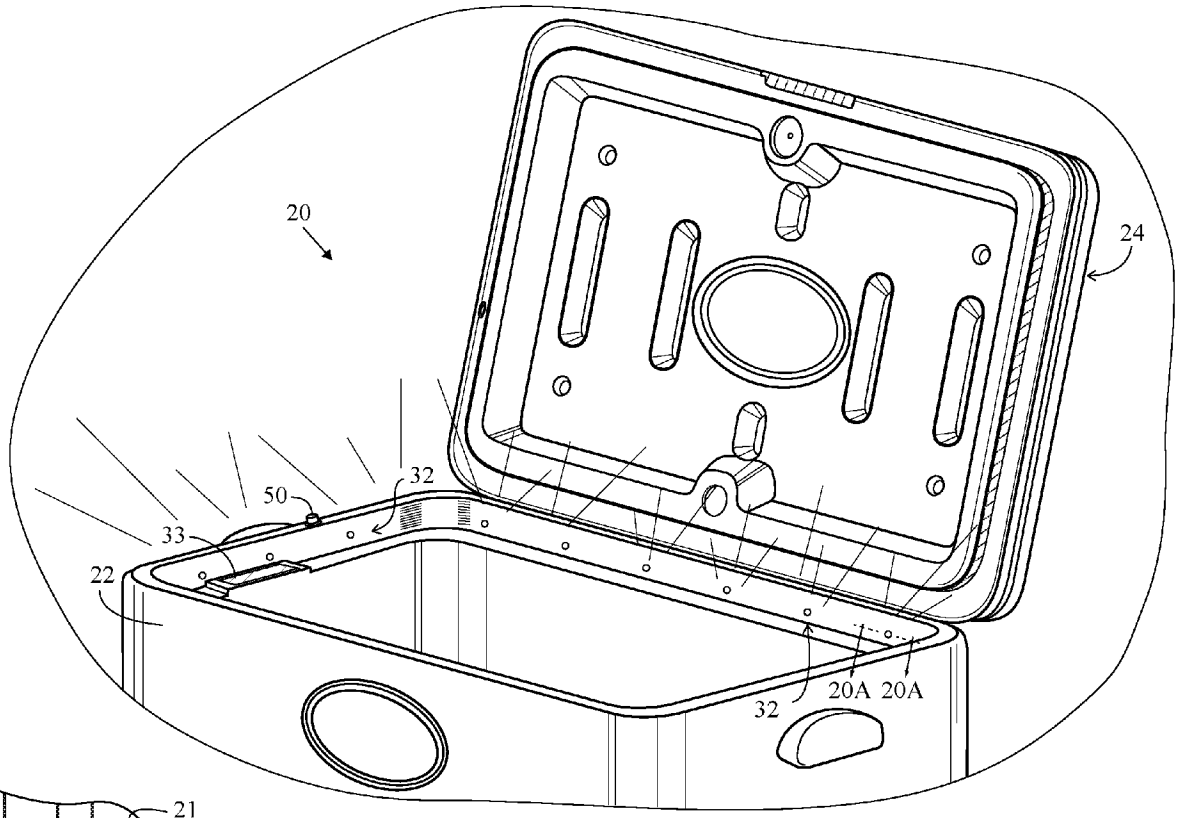
FIG. 20 an illustration of a cooler with LED lighting with a lid open to automatically activate the LED lighting.
Figure 20A:
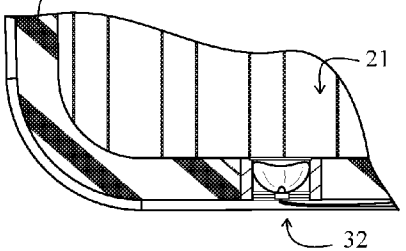
FIG. 20A is an isolated cross-sectional view of a portion of the cooler to illustrate an LED covered by a lens.
Figure 21:
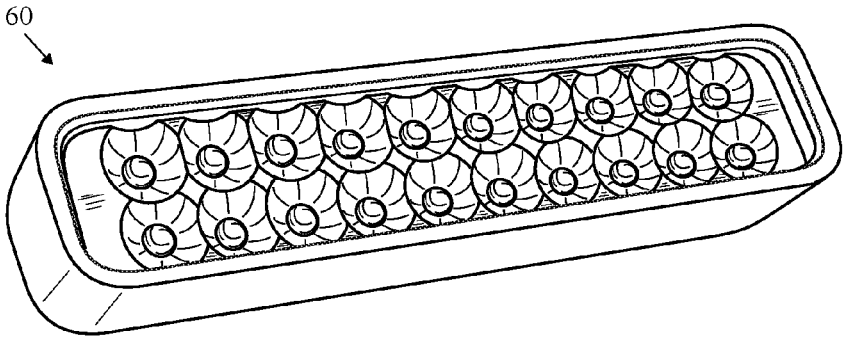
FIG. 21 is an isolated view of a LEDS within a lens.

A preferred embodiment of a cooler 20 is shown in FIGS. 20 and 20A. The cooler has a lens 33 that covers the LEDs 32. The lens is preferably transparent. Alternatively, the lens 33 is opaque or provides for a glow when illuminated by the LEDs. FIG. 21 illustrates a light bar 60 containing LEDS within an lens.

Preferably the liner of the cooler 20 is composed of a FDA grade polypropylene material infused with colloidal silver to kill bacteria. Alternatively, the liner is infused with TEFLON® material to prevent staining.

Figure 22:
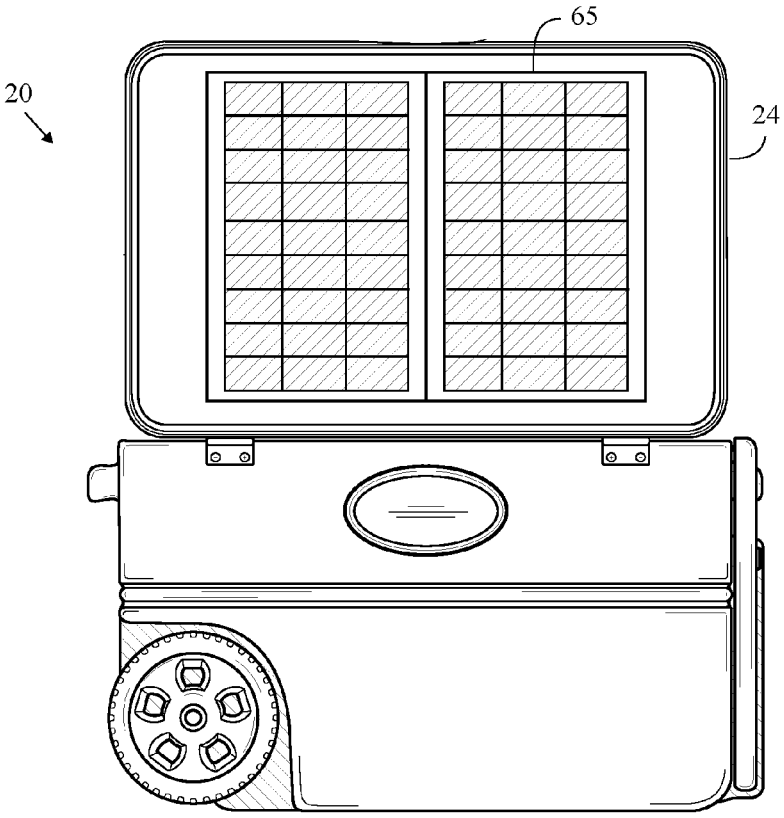
FIG. 22 an illustration of a cooler with LED lighting with a lid open to automatically activate the LED lighting and solar panels on an exterior of the lid.

Yet another embodiment is shown in FIG. 22 wherein the cooler 20 includes solar panels 65 for providing power to the cooler 20. The solar panels could provide power not only for the LEDs 32 but also equipment connected to a USB port in the cooler 20.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim as my invention:

1. A portable cooler comprising:

a main body having a plurality of insulated walls that define an interior chamber;

a lid attached to the main body;

a single light bar comprising a plurality of LEDs positioned continuously around an entire length of a perimeter of an upper region of the main body;

a lens covering the plurality of LEDs;

a battery for providing power to each of the plurality of LEDs;

at least one resistor positioned between the battery and the plurality of LEDs;

a magnet positioned in the lid; and a Hall effect sensor positioned between the battery and the plurality of LEDS, the Hall effect sensor comprising a regulator, a Hall element, an amplifier, and a Schmitt trigger;

wherein the Hall effect sensor is in a closed state when the lid of the cooler is open and a magnetic field of the magnet is in an activating location, thereby allowing power to flow from the battery to the plurality of LEDs for automatically illuminating the interior chamber of the portable cooler.

2. The cooler according to claim 1 wherein the lens is transparent.

3. The cooler according to claim 1 wherein the lens is opaque.

4. The cooler according to claim 1 further comprising solar panels.

5. The cooler according to claim 4 further comprising a USB port in communication with the solar panels.

* * * * *